US011644257B1

(12) United States Patent
Roe et al.

(10) Patent No.: US 11,644,257 B1
(45) Date of Patent: May 9, 2023

(54) AUTO-LOCKING MAGAZINE EXTENSION

(71) Applicant: Shadow Systems LLC, Plano, TX (US)

(72) Inventors: Richard Trevor Simpson Roe, Plano, TX (US); Benjamin Ni Ye, North Richland Hills, TX (US)

(73) Assignee: Shadow Systems LLC, Plano, TX (US)

( * ) Notice: Subject to any disclaimer, the term of this patent is extended or adjusted under 35 U.S.C. 154(b) by 0 days.

(21) Appl. No.: 17/693,839

(22) Filed: Mar. 14, 2022

Related U.S. Application Data

(60) Provisional application No. 63/299,731, filed on Jan. 14, 2022.

(51) Int. Cl.
*F41A 9/71* (2006.01)
*F41A 17/38* (2006.01)

(52) U.S. Cl.
CPC ..... *F41A 9/71* (2013.01); *F41A 17/38* (2013.01)

(58) Field of Classification Search
CPC ..... F41A 9/69; F41A 9/71; F41A 9/65
USPC ..... 42/49.02, 49.01, 7, 50
See application file for complete search history.

(56) References Cited

U.S. PATENT DOCUMENTS 5,666,752 A * 9/1997 Grams ..... F41A 9/71 42/49.02
6,557,287 B2 * 5/2003 Wollmann ..... F41A 9/65 42/50
6,568,115 B2 5/2003 Beretta
6,928,764 B2 8/2005 Freed
7,117,622 B2 10/2006 Freed et al.
7,509,767 B2 3/2009 Bolen
D593,633 S 6/2009 Fitzpatrick et al.
D600,303 S 9/2009 Fitzpatrick et al.
7,698,844 B2 4/2010 Gruber et al.
7,712,243 B2 5/2010 Morando
7,797,871 B2 9/2010 Bubits
7,810,269 B2 10/2010 Zukowski et al.
7,823,312 B2 11/2010 Faifer
D632,752 S 2/2011 Fitzpatrick et al.
D633,164 S 2/2011 Fitzpatrick et al.
D633,589 S 3/2011 Fitzpatrick et al.
D633,590 S 3/2011 Fitzpatrick et al.
D642,234 S 7/2011 Marfione et al.
D642,647 S 8/2011 Fitzpatrick et al.
8,225,541 B2 7/2012 Bigley et al.
D666,270 S 8/2012 Taylor
D670,350 S 11/2012 Emde
D670,784 S 11/2012 Emde
D680,613 S 4/2013 Fitzpatrick et al.
D681,151 S 4/2013 Fitzpatrick et al.
D688,766 S 8/2013 Fitzpatrick et al.
D688,767 S 8/2013 Bennett et al.
D691,233 S 10/2013 Bennett et al.
8,561,334 B2 10/2013 Metzger
(Continued)

*Primary Examiner* — Reginald S Tillman, Jr.
(74) *Attorney, Agent, or Firm* — Kim IP Law Group LLC

(57) ABSTRACT

A magazine extender is provided. The magazine extender includes a baseplate structured to receive a lower open end of a magazine; a side bracket structured to couple to the baseplate for securing the magazine; and a locking pin selectively moveable into a locked position to lock the side bracket to the baseplate and an unlocked position to unlock the side bracket from the baseplate. The locking pin of the magazine extender is prevented from being moved to the unlocked position by a handgrip of a firearm when the magazine is inserted into the handgrip.

26 Claims, 12 Drawing Sheets

(56) References Cited

U.S. PATENT DOCUMENTS

| | | | |
|---|---|---|---|
| 8,590,202 | B2 | 11/2013 | Keng |
| D695,378 | S | 12/2013 | Fitzpatrick et al. |
| 8,689,475 | B2 | 4/2014 | Battaglia |
| D704,790 | S | 5/2014 | Mayberry et al. |
| 8,713,835 | B1 | 5/2014 | Calvert |
| D706,379 | S | 6/2014 | Iannello et al. |
| D706,895 | S | 6/2014 | Zayatz et al. |
| D707,783 | S | 6/2014 | Kielsmeier et al. |
| 8,752,317 | B1 | 6/2014 | Calvert |
| D712,500 | S | 9/2014 | Nakayama et al. |
| 8,819,977 | B2 | 9/2014 | Corso |
| D716,903 | S | 11/2014 | Larmer et al. |
| 8,887,428 | B1 | 11/2014 | Lemoine |
| D727,456 | S | 4/2015 | Schefter et al. |
| D735,831 | S | 8/2015 | Faifer |
| D736,337 | S | 8/2015 | Kielsmeier et al. |
| D738,454 | S | 9/2015 | Smith |
| D739,490 | S | 9/2015 | Iannello et al. |
| D748,219 | S | 1/2016 | Kielsmeier et al. |
| 9,285,176 | B2 | 3/2016 | Bentley |
| 9,303,948 | B2 | 4/2016 | Freed |
| 9,310,161 | B2 | 4/2016 | Ermossa |
| D755,336 | S | 5/2016 | Nakayama et al. |
| D757,884 | S | 5/2016 | Kielsmeier et al. |
| 9,354,011 | B2 | 5/2016 | Cooke et al. |
| D765,812 | S | 9/2016 | Kielsmeier et al. |
| D765,813 | S | 9/2016 | Roberts et al. |
| D767,705 | S | 9/2016 | Freed |
| 9,448,022 | B2 | 9/2016 | Shreve |
| D769,397 | S | 10/2016 | Lam et al. |
| D783,111 | S | 4/2017 | Hillis |
| 9,664,469 | B2 | 5/2017 | DiChario |
| D790,649 | S | 6/2017 | Daniel et al. |
| D795,988 | S | 8/2017 | Geissele |
| 9,772,151 | B1 | 9/2017 | Sanderson et al. |
| D798,983 | S | 10/2017 | Chen |
| D799,631 | S | 10/2017 | Chen |
| D804,603 | S | 12/2017 | Kielsmeier et al. |
| D808,491 | S | 1/2018 | Chen |
| D808,492 | S | 1/2018 | Chen |
| D808,493 | S | 1/2018 | Lee |
| D809,085 | S | 1/2018 | Geissele |
| D810,223 | S | 2/2018 | Kielsmeier et al. |
| 9,915,487 | B2 | 3/2018 | Fitzpatrick et al. |
| 9,945,627 | B2 | 4/2018 | Porat |
| D817,435 | S | 5/2018 | Chen |
| D821,533 | S | 6/2018 | Nuss |
| 10,006,730 | B1 | 6/2018 | Pikielny |
| D823,975 | S | 7/2018 | Anderson |
| 10,018,438 | B2 | 7/2018 | Biran |
| 10,041,752 | B2 | 8/2018 | Ladner |
| 10,048,030 | B2 | 8/2018 | Corso |
| D834,130 | S | 11/2018 | Schefter et al. |
| D836,745 | S | 12/2018 | Benson et al. |
| 10,161,705 | B2 | 12/2018 | Keng et al. |
| 10,190,835 | B2 | 1/2019 | Hsu et al. |
| D841,758 | S | 2/2019 | Novak et al. |
| 10,260,827 | B2 | 4/2019 | Mock |
| 10,260,831 | B2 | 4/2019 | Biran et al. |
| D849,178 | S | 5/2019 | Ding et al. |
| 10,317,153 | B2 | 6/2019 | Faifer |
| D853,520 | S | 7/2019 | Cheng |
| 10,345,063 | B1 | 7/2019 | Taylor |
| D855,736 | S | 8/2019 | Sroufe et al. |
| D858,680 | S | 9/2019 | Thomele et al. |
| D859,571 | S | 9/2019 | Spine |
| 10,401,105 | B2 | 9/2019 | Dowling et al. |
| 10,436,532 | B2 | 10/2019 | Walton |
| 10,480,880 | B2 | 11/2019 | Thomele et al. |
| D868,925 | S | 12/2019 | Novak et al. |
| D869,595 | S | 12/2019 | Cheng et al. |
| 10,591,234 | B2 | 3/2020 | Beasley |
| D883,416 | S | 5/2020 | Müller |
| D883,417 | S | 5/2020 | Müller |
| D884,110 | S | 5/2020 | Yeates et al. |
| 10,648,753 | B1 | 5/2020 | Jarratt |
| D888,180 | S | 6/2020 | Coombs et al. |
| D888,181 | S | 6/2020 | Chin |
| D889,587 | S | 7/2020 | Wallgren |
| D891,565 | S | 7/2020 | Lam |
| D892,253 | S | 8/2020 | Kielsmeier |
| D892,962 | S | 8/2020 | Roberts |
| 10,739,093 | B2 | 8/2020 | Hogan, Jr. |
| D898,852 | S | 10/2020 | Kielsmeier |
| D900,270 | S | 10/2020 | Hefer et al. |
| 10,801,792 | B2 | 10/2020 | Pini |
| 10,845,138 | B2 | 11/2020 | Landis et al. |
| 10,852,086 | B1 | 12/2020 | Hillis et al. |
| 2002/0029506 | A1 | 3/2002 | Wollmann |
| 2008/0313946 | A1 | 12/2008 | Gruber et al. |
| 2012/0073176 | A1 | 3/2012 | McManus et al. |
| 2013/0086834 | A1 | 4/2013 | Battaglia |
| 2013/0333261 | A1 | 12/2013 | Clifton, Jr. et al. |
| 2015/0308766 | A1 | 10/2015 | Bentley |
| 2016/0327354 | A1 | 11/2016 | DiChario |
| 2017/0321979 | A1 | 11/2017 | Szczepkowski et al. |
| 2018/0023909 | A1 | 1/2018 | Ladner |
| 2018/0031342 | A1 | 2/2018 | Faifer |
| 2018/0051948 | A1 | 2/2018 | Corso |
| 2018/0347929 | A1 | 12/2018 | Hsu et al. |
| 2019/0162495 | A1 | 5/2019 | Müller |
| 2019/0310040 | A1 | 10/2019 | Ladner |
| 2020/0103189 | A1 | 4/2020 | Cass |
| 2020/0348095 | A1 | 11/2020 | Lee et al. |
| 2021/0041197 | A1 | 2/2021 | Thomele et al. |

* cited by examiner

AUTO-LOCKING MAGAZINE EXTENSION

RELATED APPLICATIONS

The present application claims the benefit of U.S. Provisional Patent Application No. 63/299,731, filed on Jan. 14, 2022 and entitled "AUTO-LOCKING MAGAZINE EXTENSION," the entire contents of which are expressly incorporated herein by reference.

BACKGROUND OF THE INVENTION

Magazine extenders for increasing the capacity of firearm magazines are known. Such extenders typically operate by coupling to a lower open end of a magazine to increase the length and volume thereof and provide more room for additional rounds.

Since firearms are subject to substantial forces during operation, such as those caused by recoil or by dropping the firearm or magazine on a hard surface, it is desirable that a magazine extender be affixed to a magazine in a substantially robust and secure manner that prevents dislodgment. It is also desirable that the locking mechanism and associated components of the extender do not interfere with the internal workings of the magazine, such as the magazine spring and follower. Since dirt and debris accumulated during operation of a firearm can hinder reliability of magazines and extenders, users also strongly prefer extenders that can be affixed to or removed from a magazine in the field in a toolless (or near toolless) fashion.

BRIEF SUMMARY OF THE INVENTION

Various embodiments of the subject disclosure provide durable auto-locking magazine extenders, magazines with auto-locking magazine extenders, and firearm assemblies with magazines having auto-locking magazine extenders. At least some embodiments of the auto-locking magazine extender also resist inadvertent disassembly or damage during operation of a firearm and are capable of being installed/uninstalled in a toolless (or near toolless) fashion.

In accordance with an exemplary embodiment of the subject disclosure, a magazine extender is provided. The extender includes a baseplate structured to receive a lower open end of a magazine; a side bracket structured to couple to the baseplate for securing the magazine; and a locking pin selectively moveable into a locked position to lock the side bracket to the baseplate and an unlocked position to unlock the side bracket from the baseplate, in which the locking pin is prevented from being moved to the unlocked position by a handgrip of a firearm when the magazine is inserted into the handgrip.

In accordance with an aspect of the subject disclosure, the baseplate includes a securing slot sized to receive a rail of the magazine.

In accordance with another aspect of the subject disclosure, the baseplate includes a floor having an upper surface positioned to engage a magazine spring of the magazine In accordance with still another aspect of the subject disclosure the baseplate includes a guide channel and the side bracket includes a leg engaging with the guide channel when the side bracket is coupled to the baseplate.

In accordance with yet another aspect of the subject disclosure the baseplate includes a floor having a window, the side bracket includes a through-bore aligned with the window when the side bracket is secured to the baseplate, and the locking pin includes a shaft positioned within the through-bore and a key structured to engage with the window of the baseplate when the locking pin is moved to the locked position.

In accordance with still another aspect of the subject disclosure, the key of the locking pin is shaped to engage the window of the baseplate only when the locking pin is in a single rotational orientation.

In accordance with yet another aspect of the subject disclosure, the key and window are each trapezoid-shaped.

In accordance with still another aspect of the subject disclosure, the side bracket includes a receptacle in communication with the through-bore and the locking pin has a stop positioned within the receptacle.

In accordance with yet another aspect of the subject disclosure, the receptacle has an upper face and the floor of the baseplate has an upper surface, the upper face and the upper surface limiting movement of the stop within the receptacle.

In accordance with still another aspect of the subject disclosure, the side bracket includes an upper surface and a portion of the shaft of the locking pin protrudes above the upper surface when the locking pin is moved to the unlocked position.

In accordance with yet another aspect of the subject disclosure, the portion of the shaft does not protrude above the upper surface of the side bracket when the locking pin is moved to the locked position.

In accordance with still another aspect of the subject disclosure, the handgrip of the firearm prevents the portion of the locking pin from protruding fully above the upper surface of the side bracket when the magazine is inserted into the handgrip of the firearm, thereby preventing the locking pin from being moved to the unlocked position.

In accordance with another exemplary embodiment of the subject disclosure, an extended magazine is provided. The extended magazine includes a magazine having a lower open end; a baseplate structured to receive the lower open end of the magazine; a side bracket structured to couple to the baseplate for securing the magazine; and a locking pin selectively moveable into a locked position to lock the side bracket to the baseplate and an unlocked position to unlock the side bracket from the baseplate, in which the locking pin is prevented from being moved to the unlocked position by a handgrip of a firearm when the magazine is inserted into the handgrip.

In accordance with still another exemplary embodiment of the subject disclosure, a firearm assembly is provided. The firearm assembly includes a firearm having a handgrip; a magazine in the handgrip and having a lower open end; a baseplate structured to receive the lower open end of the magazine; a side bracket structured to couple to the baseplate for securing the magazine; and a locking pin selectively moveable into a locked position to lock the side bracket to the baseplate and an unlocked position to unlock the side bracket from the baseplate, in which the locking pin is prevented from being moved to the unlocked position by the handgrip of the firearm.

In accordance with yet another exemplary embodiment of the subject disclosure, a magazine extender is provided for coupling to an open end of a magazine. The magazine extender includes a baseplate including an open proximal end, a closed distal end, a floor having a window and extending between the proximal and distal ends, and two side walls at opposite lateral sides of the floor, each of the side walls including a guide channel and a securing slot for receiving a rail of the magazine; a side bracket including an upper surface, a lower surface, a receptacle extending upwardly from the lower surface, and a through-bore extending upwardly from the receptacle and terminating at the upper surface of the main body, and two legs extending distally, each leg sized to closely engage a respective one of the guide channels of the baseplate when the side bracket is secured to the baseplate; and a locking pin including a stop positioned within the receptacle of the side bracket, a shaft extending upwardly from the stop and into the through-bore of the side bracket, and a key extending downwardly from the stop, in which the locking pin is selectively movable into a locked position and an unlocked position, the key of the locking pin engaging with the window of the baseplate in the locked position to lock the side bracket to the baseplate, the key of the locking pin disengaged from the window of the baseplate in the unlocked position to unlock the side bracket from the baseplate, and in which a portion of the shaft of the locking pin protrudes above the upper surface of the side bracket when the locking pin is moved into the unlocked position.

BRIEF DESCRIPTION OF THE SEVERAL VIEWS OF THE DRAWINGS

The following detailed description of an exemplary embodiment of the subject disclosure will be better understood when read in conjunction with the appended drawings. For the purpose of illustrating the present disclosure, there is shown in the drawings an exemplary embodiment. It should be understood, however, that the subject application is not limited to the precise arrangements and instrumentalities shown.

DETAILED DESCRIPTION OF THE INVENTION

Reference will now be made in detail to an exemplary embodiment of the subject disclosure illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as upper, lower, top, bottom, above, below and diagonal, are used with respect to the accompanying drawings. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

"Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more exemplary embodiments. One skilled in the relevant art will recognize, in light of the description herein, that the subject disclosure can be practiced without one or more of the specific features or advantages of a particular exemplary embodiment. In other instances, additional features and advantages may be recognized in certain exemplary embodiments that may not be present in all exemplary embodiments of the present disclosure.

Figure 1:
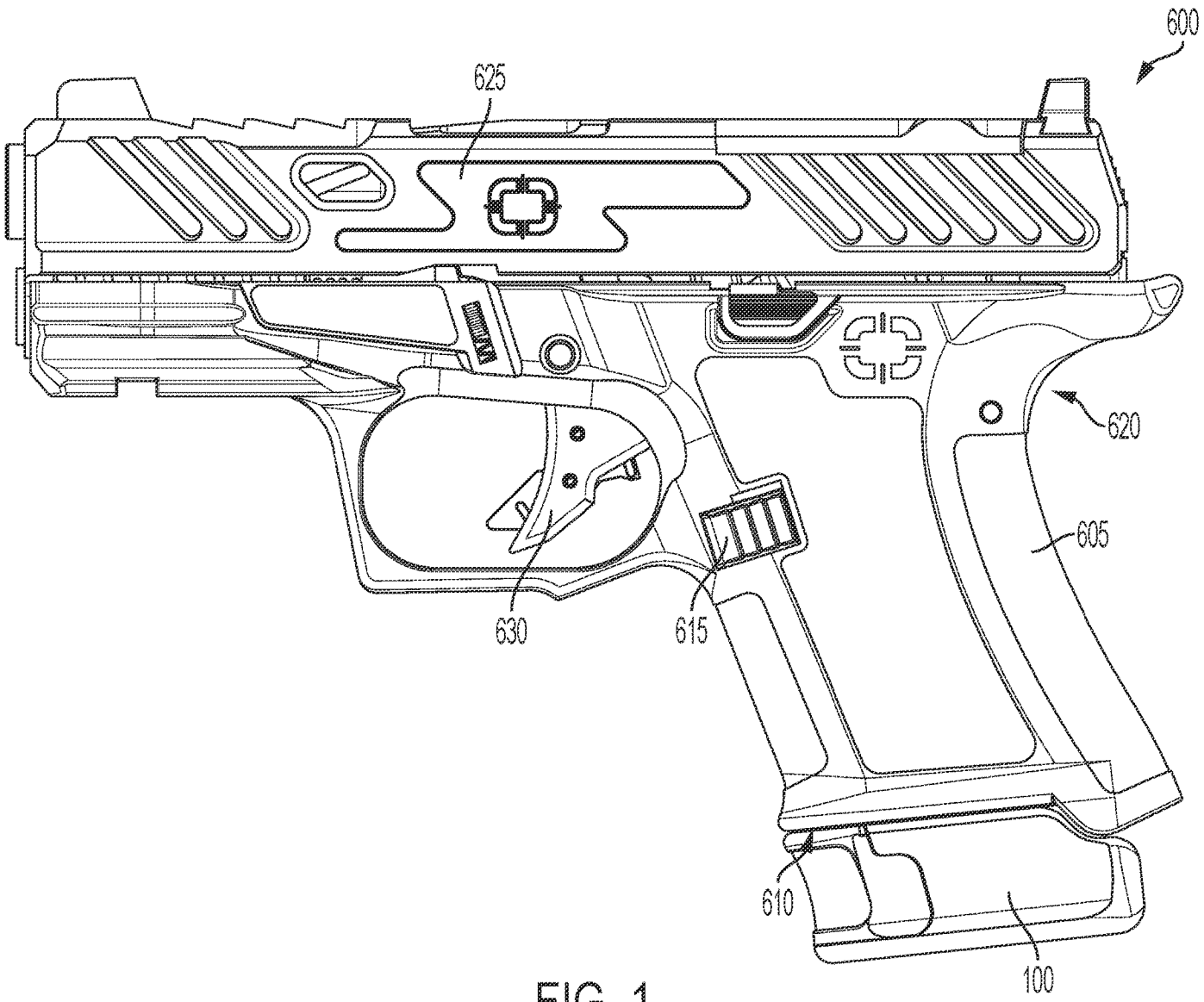
FIG. 1 is a side view of a firearm assembly including a firearm with a magazine and an auto-locking magazine extender in accordance with an exemplary embodiment of the subject disclosure.
Figure 2:
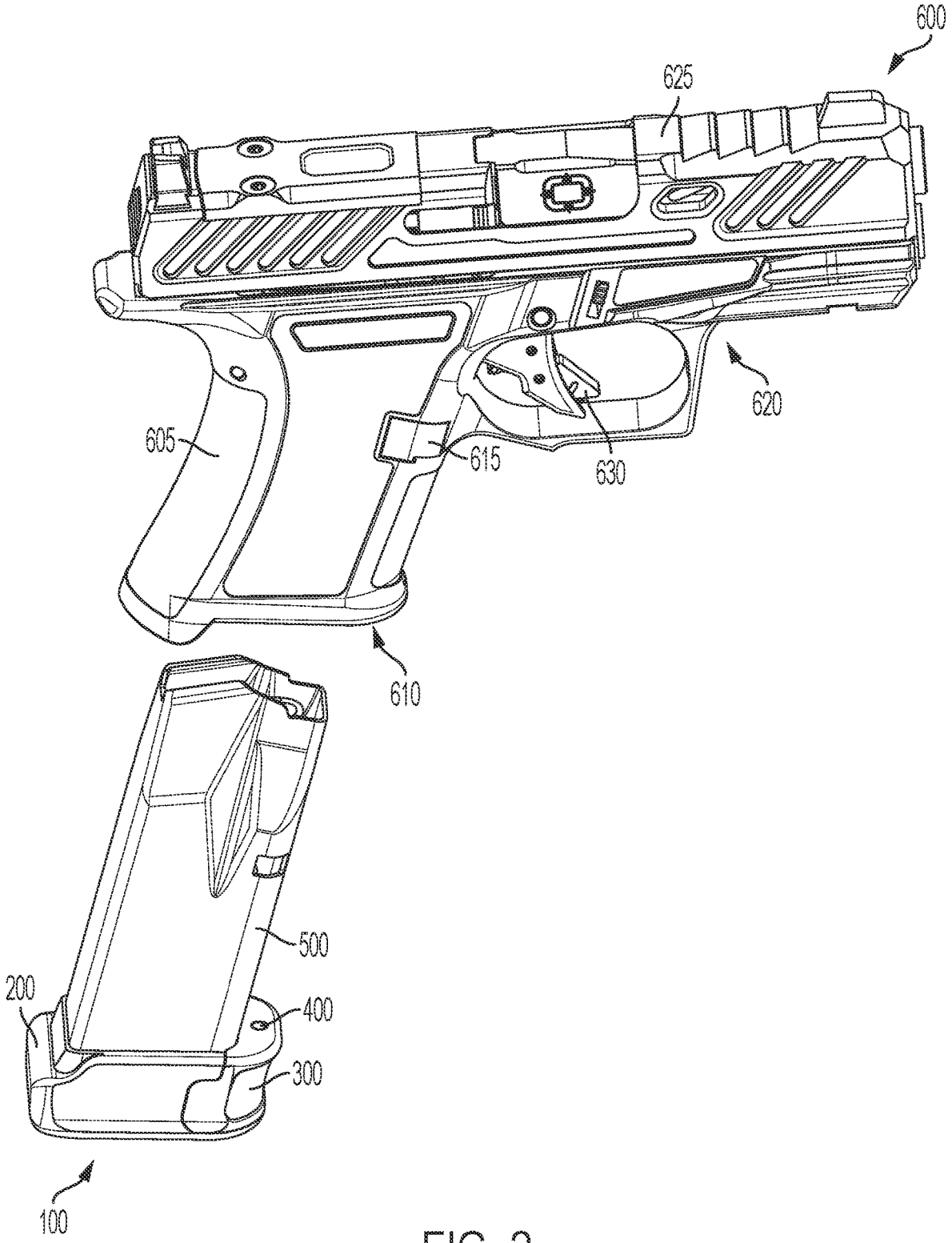
FIG. 2 is an exploded perspective view of the firearm assembly of FIG. 1.
Figure 3:
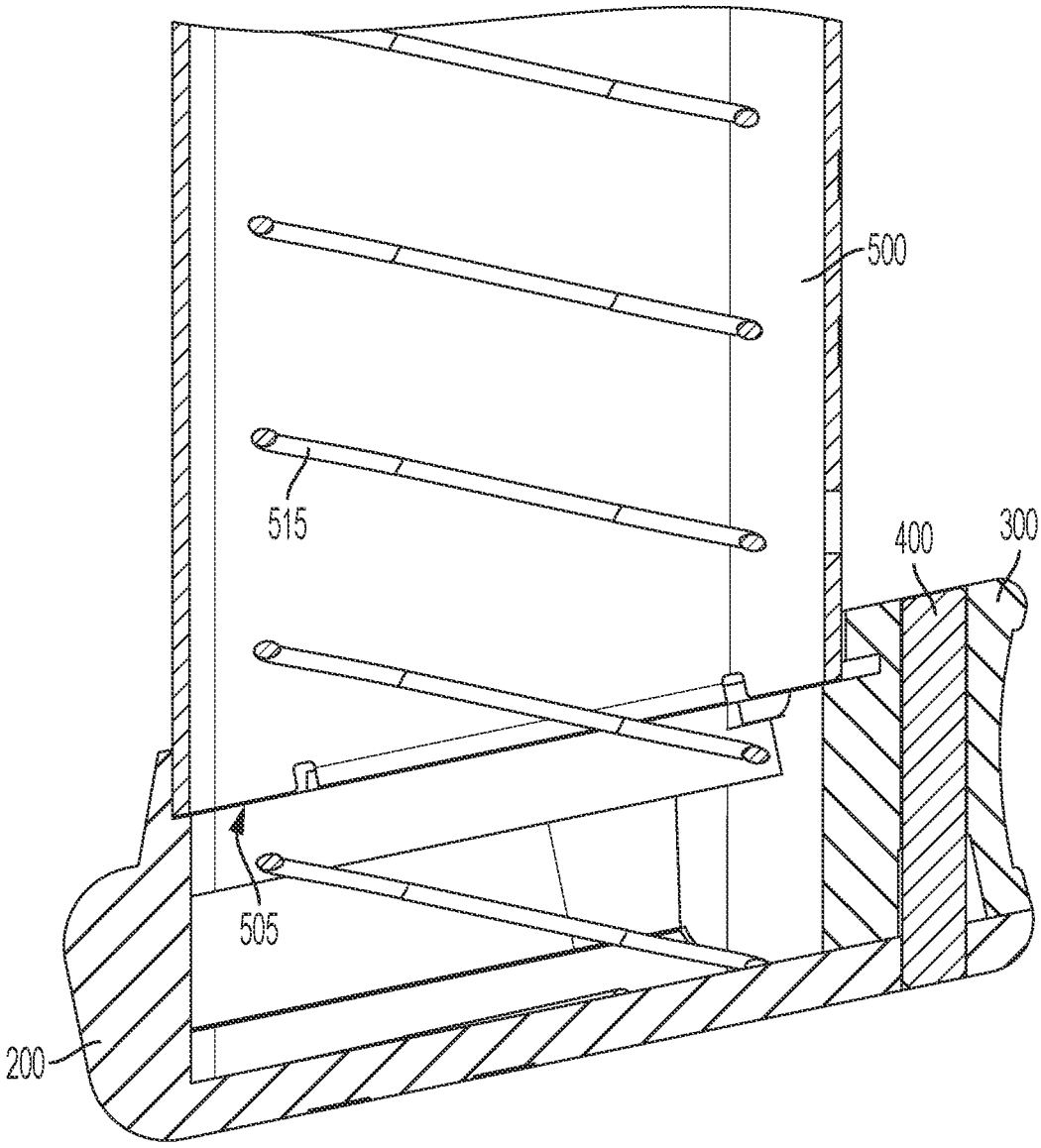
FIG. 3 is a side sectional view of the magazine and magazine extender of FIG. 1.
Figure 4:
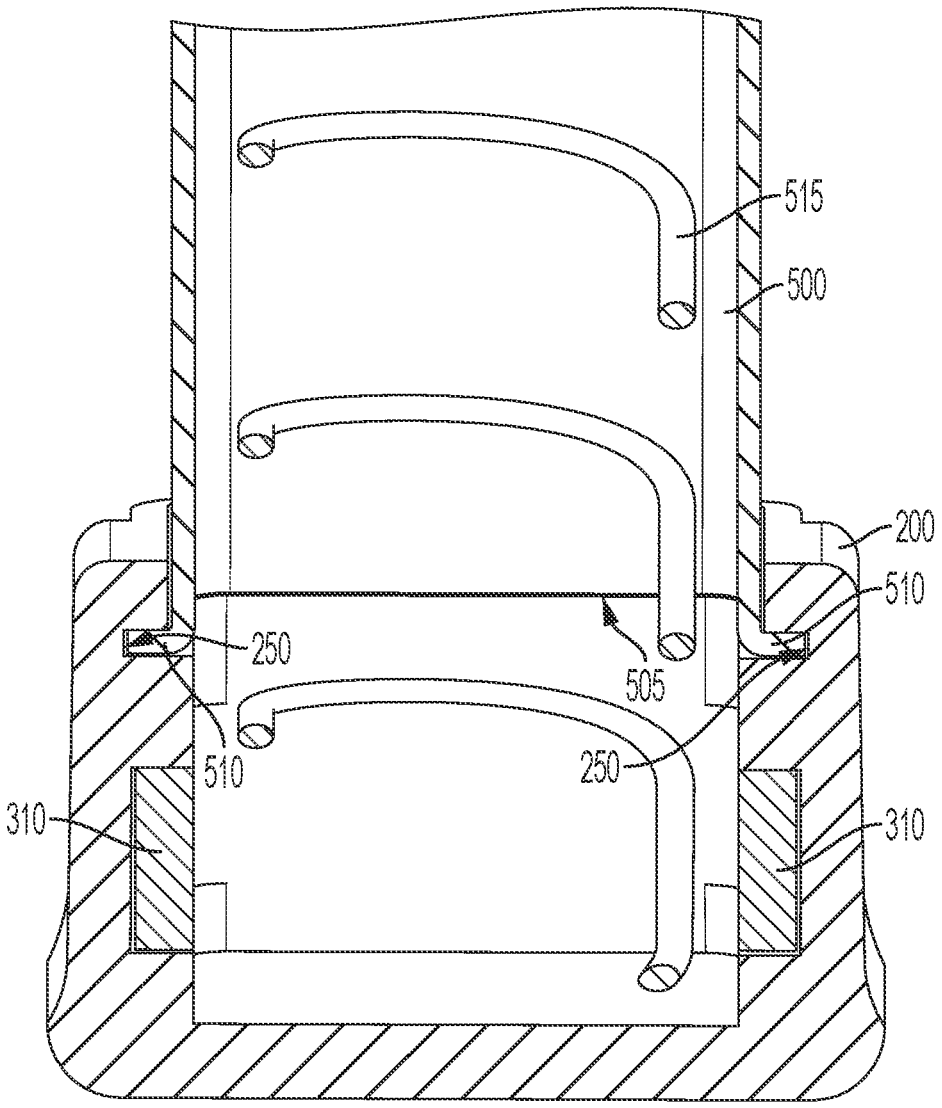
FIG. 4 is a front sectional view of the magazine and magazine extender of FIG. 1.
Figure 5:
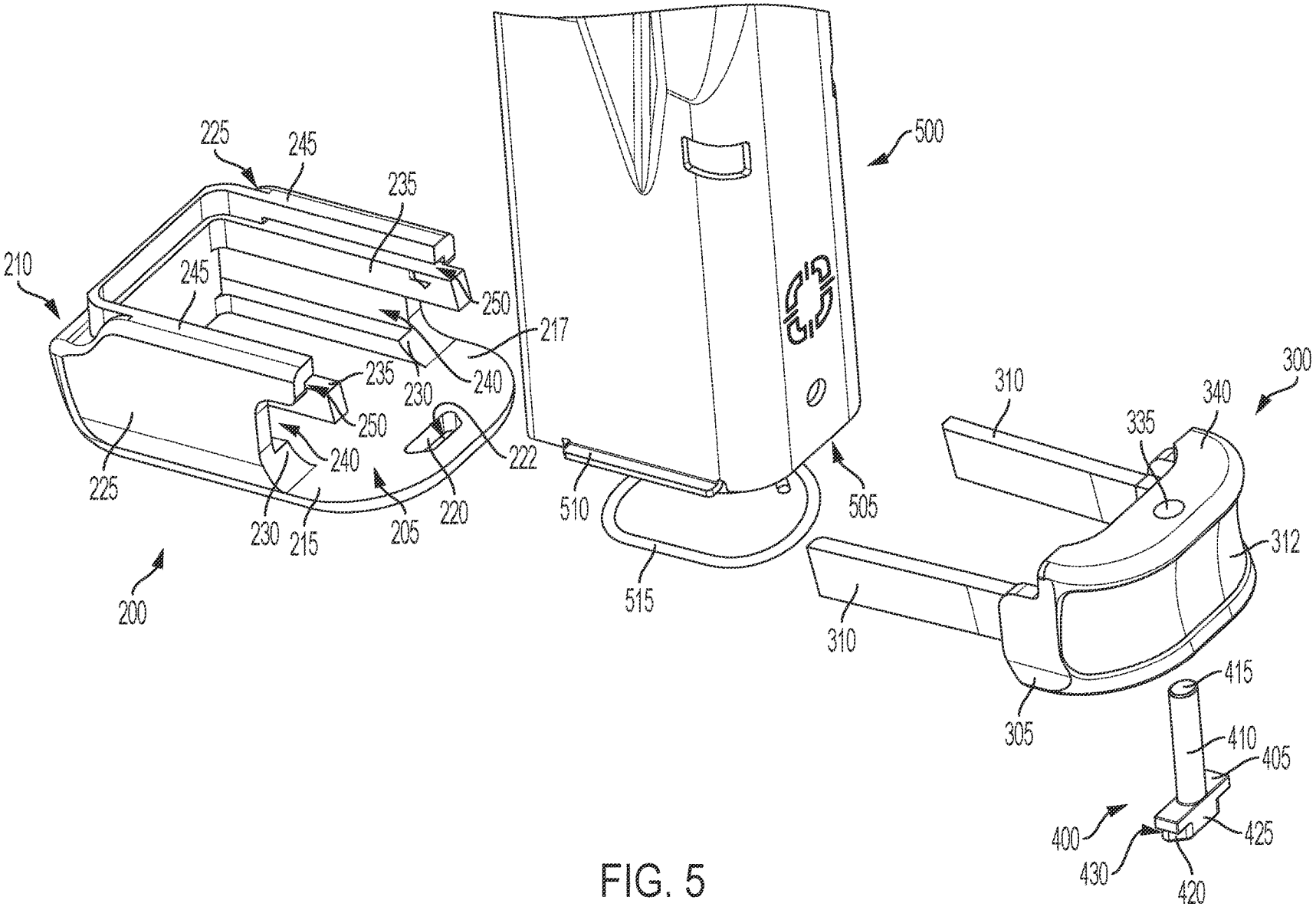
FIG. 5 is an exploded perspective view of the magazine and magazine extender of FIG. 1.
Figure 6:
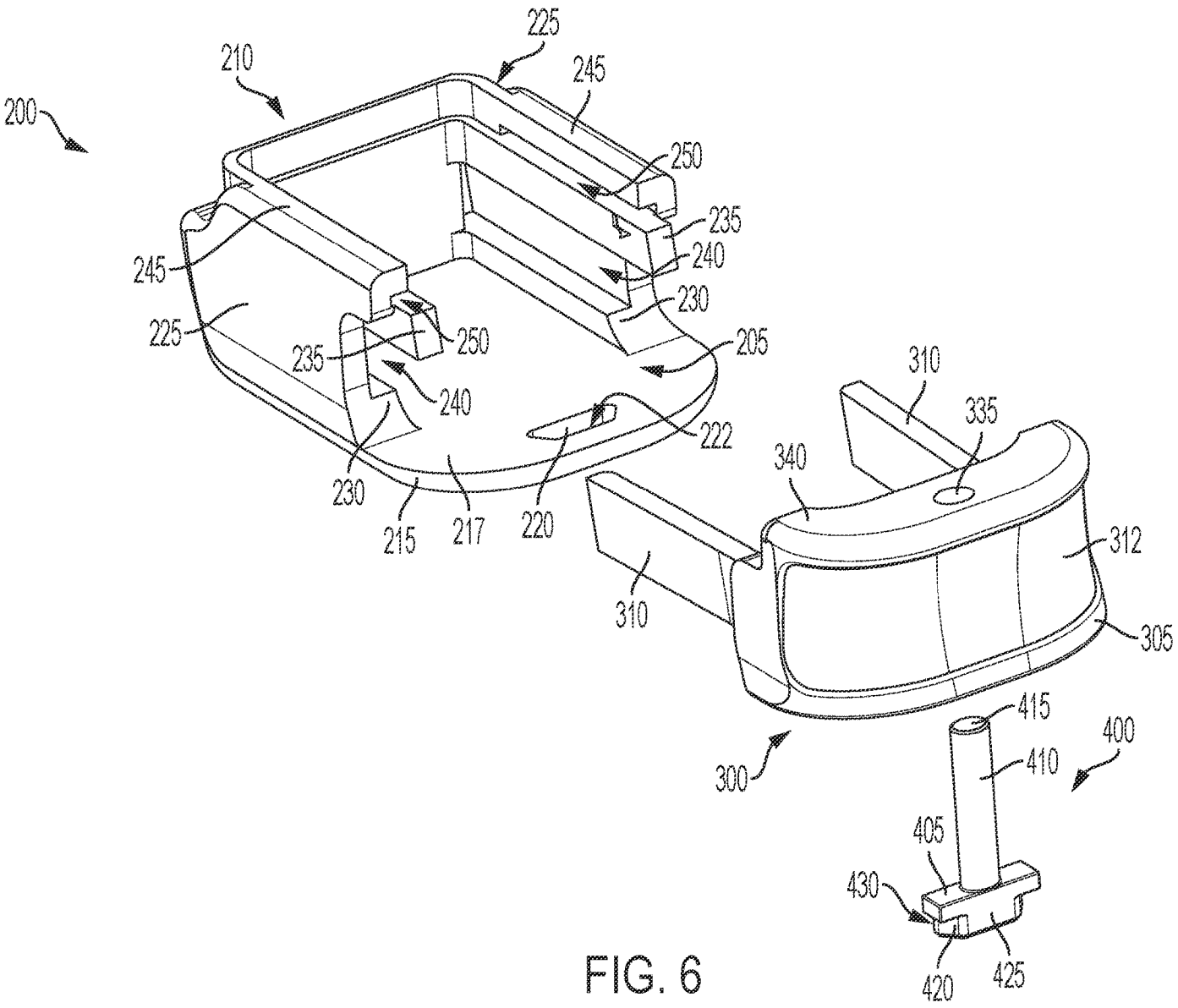
FIG. 6 is an exploded perspective view of the magazine extender of FIG. 1.
Figure 7:
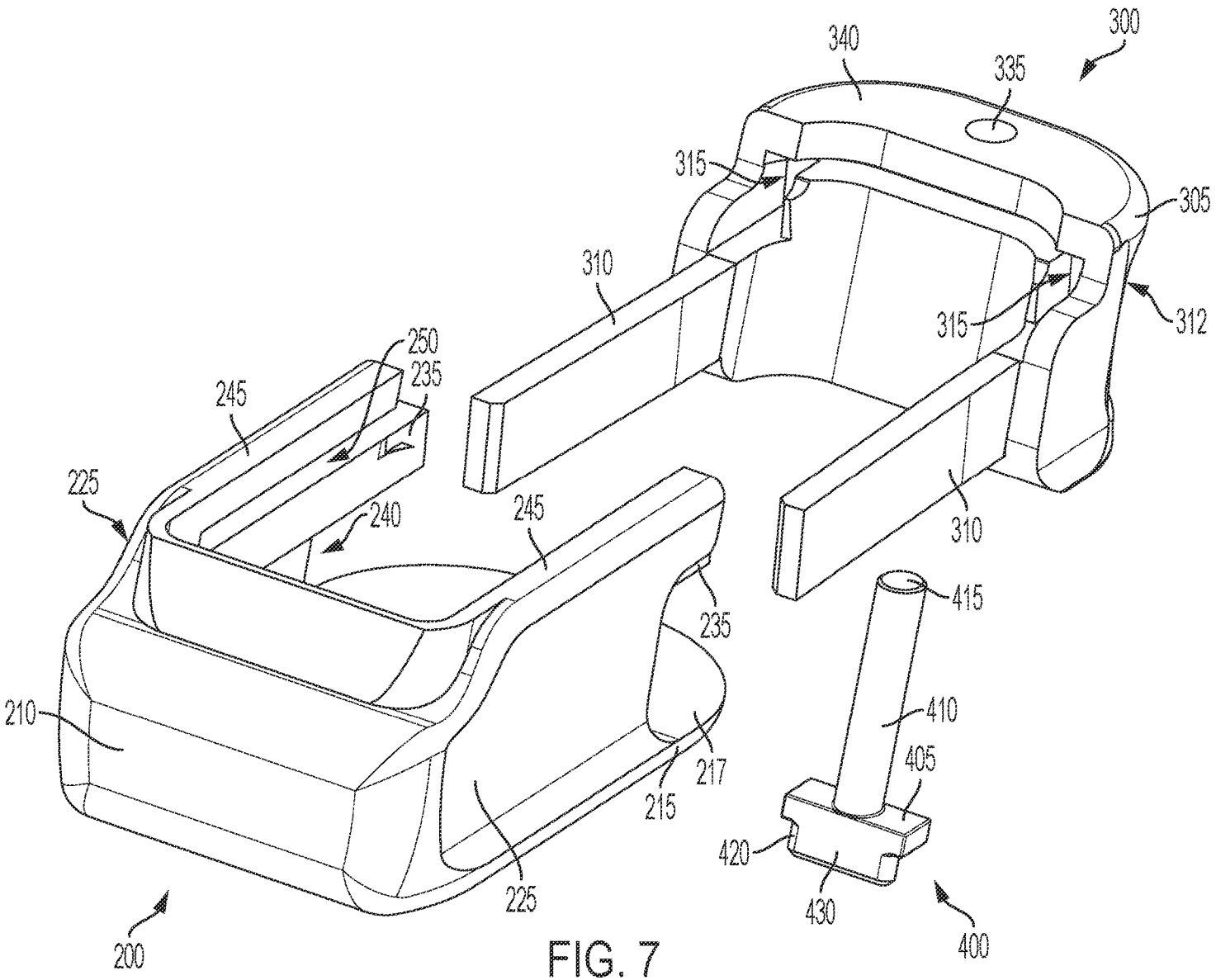
FIG. 7 is another exploded perspective view of the magazine extender of FIG. 1.
Figure 8:
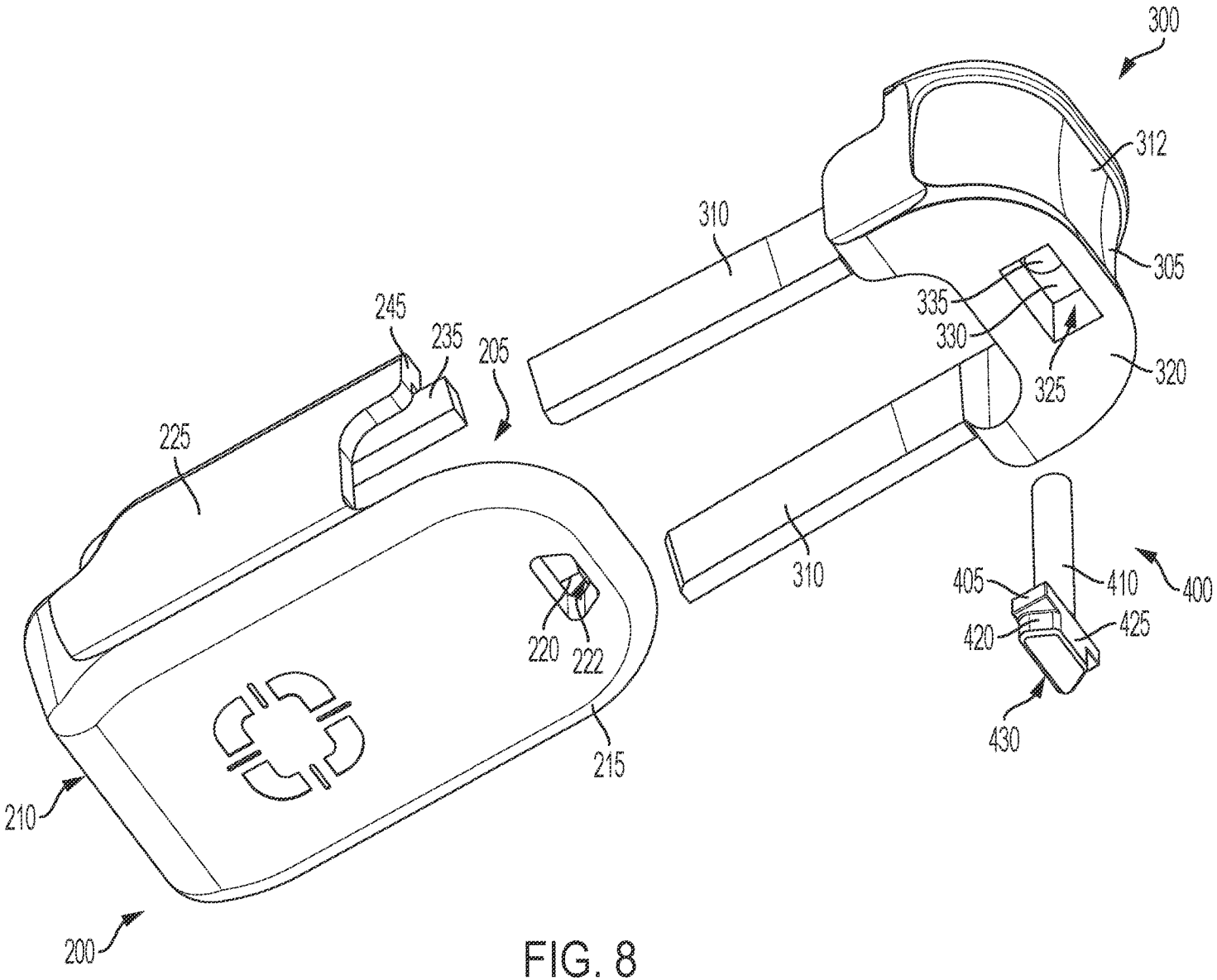
FIG. 8 is still another exploded perspective view of the magazine extender of FIG. 1.

Referring now to the Figures, there is shown an exemplary auto-locking magazine extender 100 in accordance with the subject disclosure. Magazine extender 100 increases the round capacity of a magazine 500 of handgun 600 or other firearm, such as a rifle or shotgun. As best shown in FIGS. 1 and 2, handgun 600 includes a receiver assembly 620 having a hollow handgrip 605 sized to receive magazine 500, a magazine release button 615 on handgrip 605, a slide 625 coupled to the upper portion of receiver assembly 620 and a trigger assembly 630 operable to fire rounds stored in magazine 500. Handgun 600 also includes other well-known components and structures not shown or described herein.

As shown in FIGS. 3-10, magazine extender 100 includes a baseplate 200 for receiving an open end 505 of magazine 500, a side bracket 300 structured to releasably couple to baseplate 200 for securing magazine 500 thereto and a locking pin 400 for locking side bracket 300 to baseplate 200.

As best shown in FIGS. 5 through 8, baseplate 200 includes an open proximal end 205, a closed and rounded distal end 210, a beveled floor 215 with an upper surface 217 extending between proximal and distal ends 205, 210 and having a trapezoid-shaped window 220 at proximal end 205, and two side walls 225 at opposite lateral sides of floor 215 and extending between proximal and distal ends 205, 210. The inner face of each wall 225 includes a lower lateral protrusion 230 and a guide 235 which together form a guide channel 240 extending between proximal and distal ends 205, 210. Each guide 235 also cooperates at its top end with a lateral and inwardly projecting lip 245 to form a securing slot 250 sized to receive rails 510 of magazine 500. Baseplate 200 and its features are formed integrally into one monolithic piece (such as by injection molding), though it should be appreciated that baseplate 105 may be formed from multiple separate pieces and be constructed from any material(s) suitable for its intended purpose.

Side bracket 300 includes a main body 305 and two legs 310 extending distally from opposite sides of main body 305, each of which is sized and positioned to closely engage a respective guide channel 240 of baseplate 200. Main body 305 includes a curved proximal face 312, two lateral and distally facing receipt channels 315, a lower surface 320, a receptacle 325 extending upwardly from lower surface 320 and having an upper face 330, and a cylindrical through-bore 335 communicating with receptacle 325 and extending upwardly therefrom and terminating at an upper surface 340. Like baseplate 200, side bracket 300 and its features are formed integrally into one monolithic piece, though it should be appreciated that side bracket 300 may be formed from multiple separate pieces and be constructed from any suitable material(s).

Locking pin 400 includes a stop 405, a cylindrical shaft 410 extending upwardly from stop 405 and terminating at an upper face 415, and a trapezoid-shaped key 420 extending downwardly from stop 405 and having respective proximal and distal faces 425, 430.

To ensure proper alignment of side bracket 300 with respect to baseplate 200, guide channels 240 of baseplate 200 closely receive legs 310 of side bracket 300 and receipt channels 315 of side bracket 300 closely receive the proximal ends of guides 235. This ensures that lower surface 320 of side bracket 300 closely engages upper surface 217 of floor 215 of baseplate 200 and aligns receptacle 325 of side bracket 300 with window 220 of baseplate 200. Shaft 410 of locking pin 400 extends upwardly through bore 335 of side bracket 300, with stop 405 being positioned within receptacle 325. When extender 100 is secured to magazine 500, upper face 330 of receptacle 325 and upper surface 217 of floor 215 limit movement of stop 405 within receptacle 325 between a lower locked position, in which proximal face 425 of key 420 engages proximal side 222 of window 220 to prevent removal of side bracket 300 laterally from baseplate 200 (see FIG. 9), and an upper unlocked position, in which key 420 clears window 220 to allow removal of side bracket 300 laterally from baseplate 200 (see FIG. 10). By ensuring that locking pin 400 locks side bracket 300 in a lower position (rather than an upper or other position), magazine extender 100 provides enhanced robustness against inadvertent unlocking and disassembly caused by a falling magazine 500 striking a hard surface (such as when magazine release button 615 is pressed in typical fashion to allow empty magazine 500 to fall out of handgun 600 under force of gravity). In such an event, magazine 500 falls straight and typically strikes the ground in an upright position (extender 100 first), upon which inertia urges locking pin 400 even more strongly into the lower locked position. Likewise, recoil forces (which typical jolt a firearm upwards) may more strongly seat locking pin 400 in the lower locked position.

Key 420 of locking pin 400 is trapezoid-shaped and sized to engage trapezoid-shaped window 220 in the assembled state only when locking pin 400 is in a specific rotational orientation. This ensures that upper face 415 of pin 400 (which is cut at an angle with respect to the axis of shaft 410) lies flush with upper surface 340 of side bracket 300 when pin 400 is in the lower locked position. While key 420 and window 220 are trapezoid-shaped, it should be appreciated that these features may be designed with different shapes or keying features to ensure proper rotational alignment of pin 400 or, alternatively, these features need not be keyed at all, such as with respect to embodiments that do not require a specific rotational orientation of pin 400. Further, although shaft 410 and through-bore 335 are generally cylindrical with cross-sections that are substantially circular in shape, it should be appreciated that these features may be designed to have different cross-sections, such as, e.g., square or triangle shaped cross-sections, and that various embodiments of the subject disclosure are not intended to be limited to any particular cross-sectional shape of shaft 410 or through-bore 335.

Figure 9:
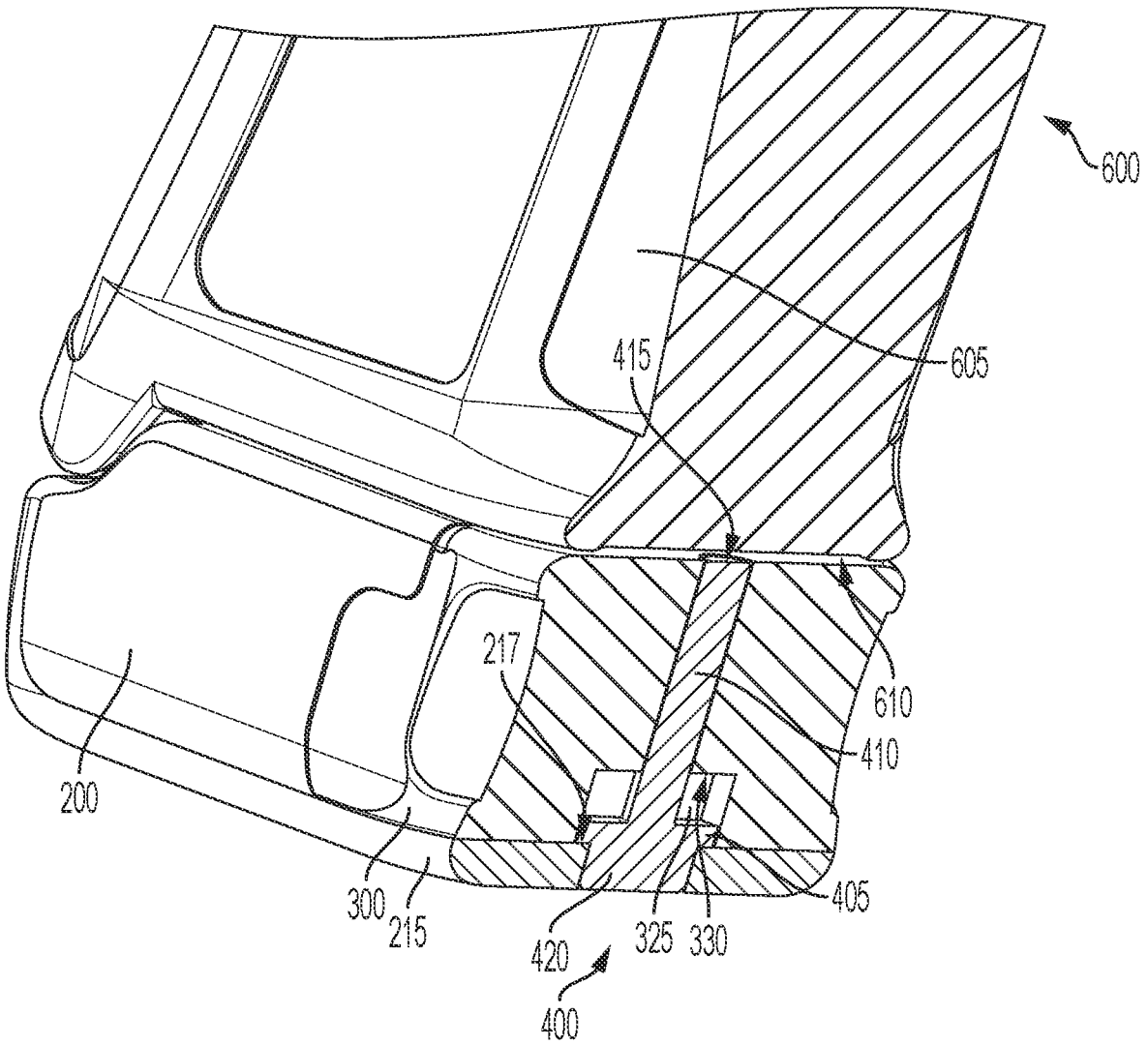
FIG. 9 is a perspective sectional view of the firearm assembly of FIG. 1 showing a locking pin in a lower locked position.
Figure 10:
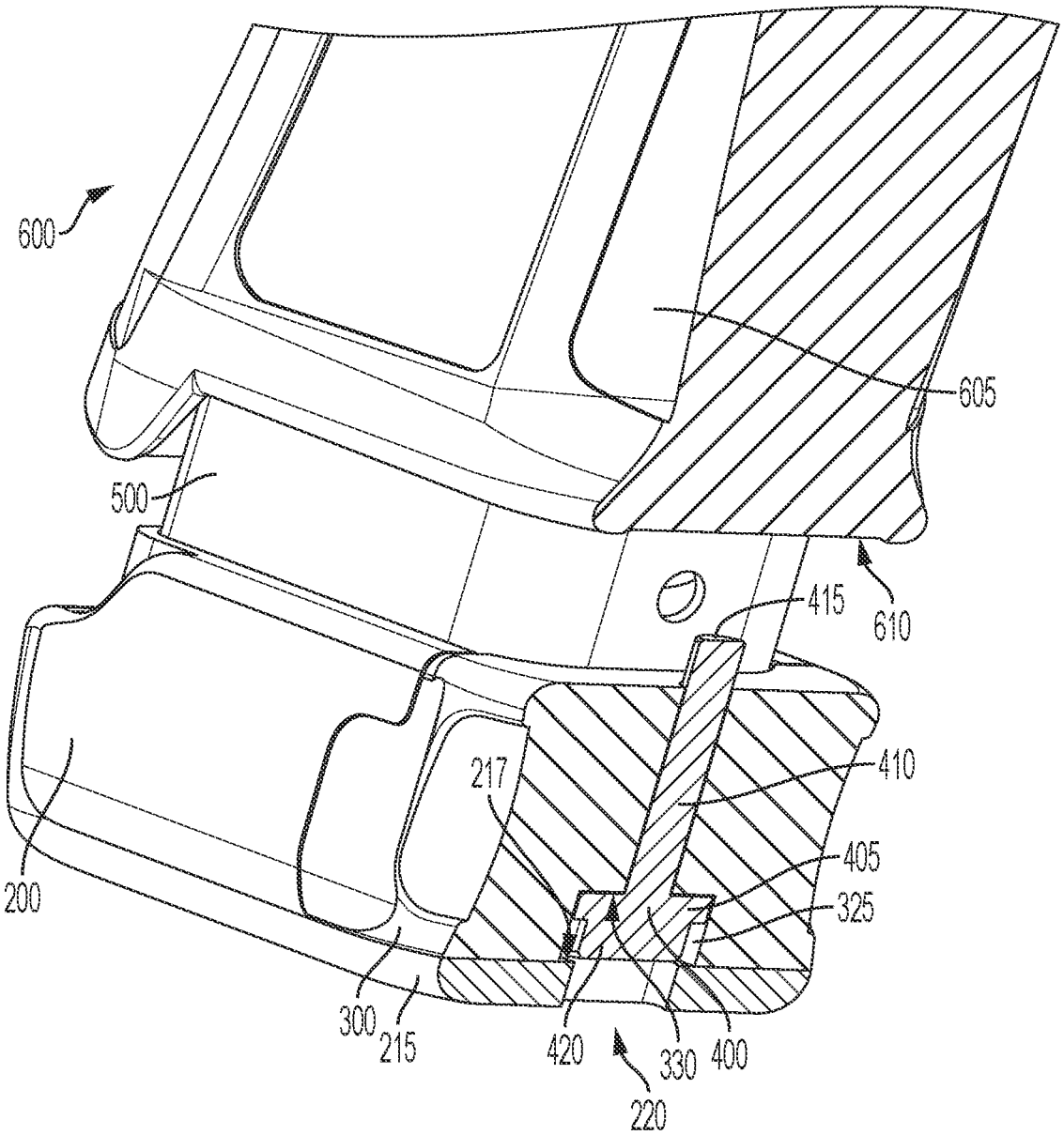
FIG. 10 is a perspective sectional view of the firearm assembly of FIG. 1 showing the locking pin in an upper unlocked position and the magazine removed partially from the firearm.

As best shown in FIGS. 9-10, when magazine 500 with magazine extender 100 is inserted and secured within handgrip 605 of handgun 600, a lower surface 610 of handgrip 605 automatically locks side bracket 300 to baseplate 200 by engaging with upper face 415 of locking pin 400 to ensure pin 400 cannot be moved into the upper unlocked position during operation of handgun 600 (see FIG. 9). However, to the extent locking pin 400 is inserted into side bracket 300 in the wrong rotational orientation, or side bracket 300 is not fully inserted into baseplate 200 to align key 420 with window 220, key 420 of pin 400 will not engage window 220, thereby maintaining locking pin 400 rigidly in the upper unlocked position. In this position, upper face 415 of shaft 410 engages and stops handgrip 605 at some distance above upper surface 340 of side bracket 300 to prevent magazine 500 from being fully inserted and secured within handgrip 605. This provides a safety feature that prohibits installation of magazine 500 into handgun 600 when magazine extender 100 is not properly assembled and secured to magazine 500. In the event locking pin 400 and/or side bracket 300 are damaged and become dislodged from baseplate 200, handgun 600 still may be safely operated at least temporarily, as biasing forces exerted against floor 215 by magazine spring 515 produce frictional forces that maintain rails 510 of magazine 500 within securing slots 250 of baseplate 200.

Figure 11:
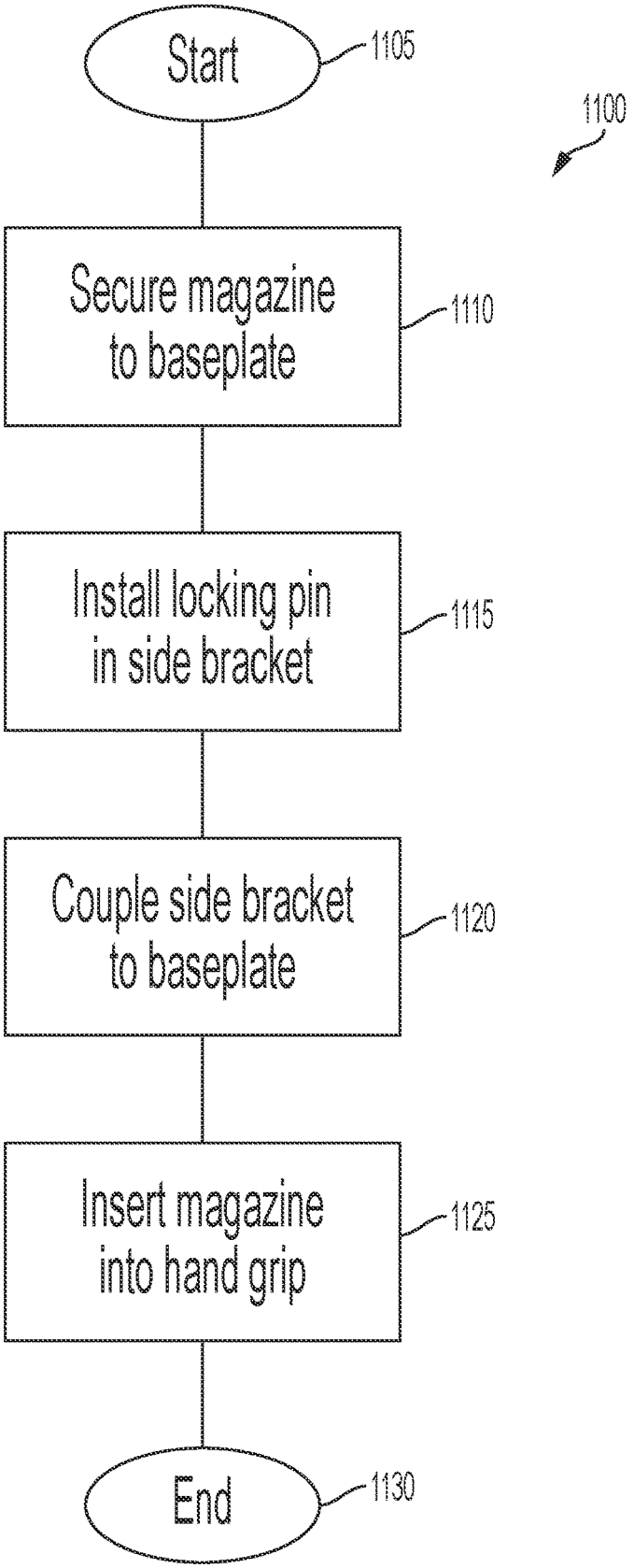
FIG. 11 is a diagram detailing a process for assembling the magazine extender of FIG. 1 on a magazine of a handgun.

Referring now to FIG. 11, there is shown a diagram detailing a process 1100 for assembling magazine extender 100 on magazine 500 of handgun 600. The process begins at step 1105 and proceeds to step 1110, at which a user compresses magazine spring 515 of magazine 500, slides rails 510 of magazine 500 distally into securing slots 250 of baseplate 200, and releases spring 515 to permit engagement of spring 515 with floor 215 of baseplate 200. The process then proceeds to step 1115. At this step, the user inserts shaft 410 of locking pin 400 upwardly into through-bore 335 of side bracket 300 until key 420 is fully maintained within receptacle 325. Then, at step 1120, the user inserts legs 310 of side bracket 300 laterally into guide channels 240 of baseplate 200 until key 420 of pin 400 aligns with window 220 of baseplate 200. The process then proceeds to step 1125, at which the user presses upper face 415 of shaft 410 downwardly to urge locking pin 400 into the lower locked position, thereby locking side bracket 300 to baseplate 200. Alternatively, locking pin 400 may be secured into the locked position by inserting and securing magazine 500 within handgrip 605 of handgun 600. Insertion of magazine 500 in this manner causes lower surface 610 of handgrip 605 to engage with upper face 415 of shaft 410 to urge locking pin 400 downwardly into the locked position. In other embodiments, locking pin 400 simply falls downwardly into the locked position under force of gravity when key 420 of locking pin 400 aligns with window 220 of baseplate 200. In still other embodiments, a biasing member (such as a compression spring) is positioned within receptacle 325 between stop 405 of pin 400 and upper face 330 of receptacle 325 to provide a biasing force to urge pin 400 into the lower locked position when key 420 and window 220 align. The process then ends at step 1130.

Figure 12:
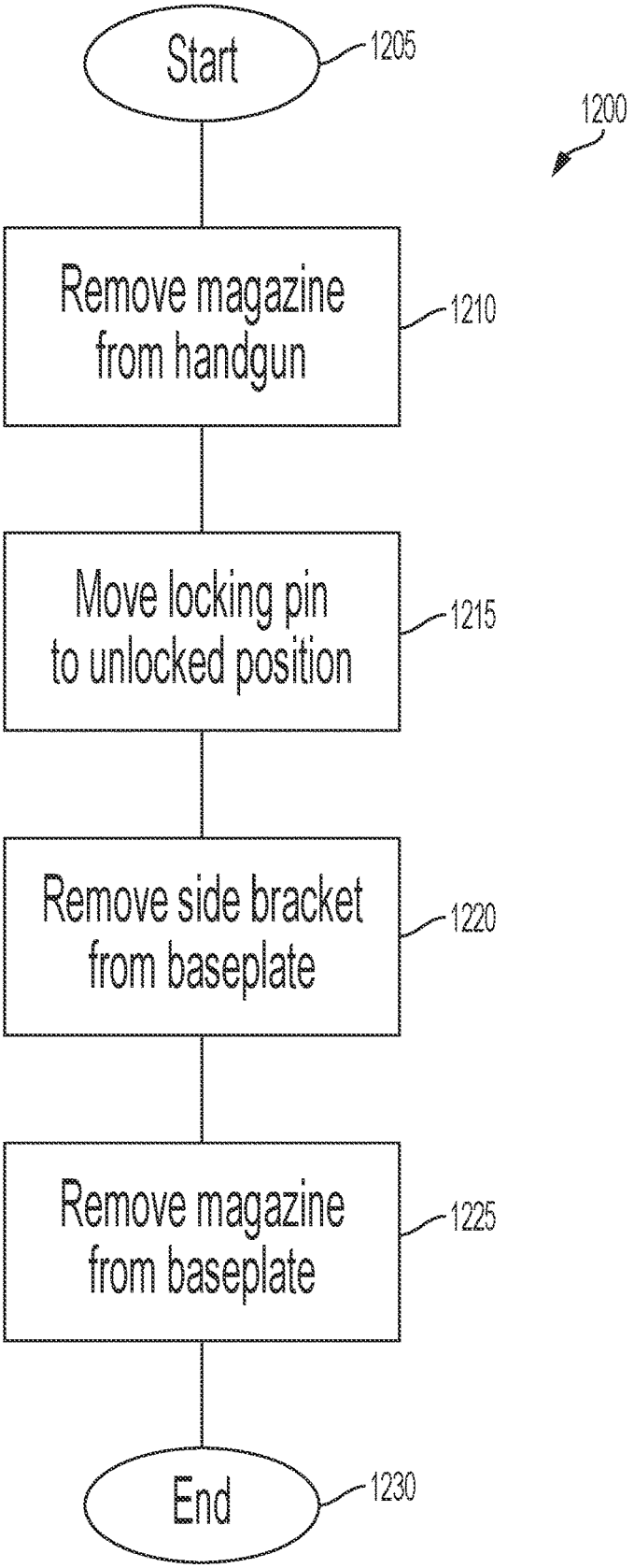
FIG. 12 is a diagram detailing a process for disassembling and removing the magazine extender of FIG. 1 from a magazine of a handgun.

Referring now to FIG. 12, there is shown a diagram detailing a process 1200 of removing magazine extender 100 from magazine 500 of handgun 600. The process begins at step 1205 and proceeds to step 1210, at which a user removes magazine 500 from handgun 600 by depressing the magazine release button 615 of firearm 600 and sliding magazine 500 downwardly out of handgrip 605. The process then proceeds to step 1215. At this step, the user inserts a fingernail, pin punch, ball point pen or other readily available tool or structure into window 220 to urge locking pin 400 upwardly into the upper unlocked position, thereby disengaging key 420 from window 220 of baseplate 200. Then, at step 1220, the user removes side bracket 300 by sliding it proximally with respect to baseplate 200. With side bracket 300 removed, the process proceeds to step 1225, at which the user compresses magazine spring 515 slightly and removes magazine 500 from baseplate 200 by sliding it proximally until rails 510 fully clear securing slots 250 of baseplate 200. The process then ends at step 1230.

It should be appreciated by those skilled in the art that changes may be made to the exemplary embodiments described above without departing from the broad inventive concept thereof. It is to be understood, therefore, that this disclosure is not limited to the particular exemplary embodiments disclosed, but it is intended to cover modifications within the spirit and scope of the claims defined herein.

What is claimed is:

1. A magazine extender, comprising:

a baseplate structured to receive a lower open end of a magazine;

a side bracket structured to couple to the baseplate for securing the magazine; and a locking pin selectively moveable into a locked position to lock the side bracket to the baseplate and an unlocked position to unlock the side bracket from the baseplate, wherein the locking pin is prevented from being moved to the unlocked position by a handgrip of a firearm when the magazine is inserted into the handgrip.

2. The magazine extender of claim 1, wherein the baseplate includes a securing slot sized to receive a rail of the magazine.

3. The magazine extender of claim 1, wherein the baseplate includes a floor having an upper surface positioned to engage a magazine spring of the magazine.

4. The magazine extender of claim 1, wherein the baseplate includes a guide channel and the side bracket includes a leg engaging with the guide channel when the side bracket is coupled to the baseplate.

5. The magazine extender of claim 1, wherein the baseplate includes a floor having a window, the side bracket includes a through-bore aligned with the window when the side bracket is secured to the baseplate, and the locking pin includes a shaft positioned within the through-bore and a key structured to engage with the window of the baseplate when the locking pin is moved to the locked position.

6. The magazine extender of claim 5, wherein the key of the locking pin is shaped to engage the window of the baseplate only when the locking pin is in a single rotational orientation.

7. The magazine extender of claim 6, wherein the key and window are each trapezoid-shaped.

8. The magazine extender of claim 5, wherein the side bracket includes a receptacle in communication with the through-bore and the locking pin has a stop positioned within the receptacle.

9. The magazine extender of claim 8, wherein the receptacle has an upper face and the floor of the baseplate has an upper surface, the upper face and the upper surface limiting movement of the stop within the receptacle.

10. The magazine extender of claim 5, wherein the side bracket includes an upper surface and a portion of the shaft of the locking pin protrudes above the upper surface when the locking pin is moved to the unlocked position.

11. The magazine extender of claim 10, wherein the portion of the shaft does not protrude above the upper surface of the side bracket when the locking pin is moved to the locked position.

12. The magazine extender of claim 10, wherein the handgrip of the firearm prevents the portion of the locking pin from protruding fully above the upper surface of the side bracket when the magazine is inserted into the handgrip of the firearm, thereby preventing the locking pin from being moved to the unlocked position.

13. An extended magazine, comprising:

a magazine having a lower open end;

a baseplate structured to receive the lower open end of the magazine;

a side bracket structured to couple to the baseplate for securing the magazine; and a locking pin selectively moveable into a locked position to lock the side bracket to the baseplate and an unlocked position to unlock the side bracket from the baseplate, wherein the locking pin is prevented from being moved to the unlocked position by a handgrip of a firearm when the magazine is inserted into the handgrip.

14. The extended magazine of claim 13, wherein the baseplate includes a securing slot sized to receive a rail of the magazine.

15. The extended magazine of claim 13, wherein the magazine includes a magazine spring and the baseplate includes a floor having an upper surface positioned to engage the magazine spring of the magazine.

16. The extended magazine of claim 13, wherein the baseplate includes a guide channel and the side bracket includes a leg engaging with the guide channel when the side bracket is coupled to the baseplate.

17. The extended magazine of claim 13, wherein the baseplate includes a floor having a window, the side bracket includes a through-bore aligned with the window when the side bracket is secured to the baseplate, and the locking pin includes a shaft positioned within the through-bore and a key structured to engage with the window of the baseplate when the locking pin is moved to the locked position.

18. The extended magazine of claim 17, wherein the key of the locking pin is shaped to engage the window of the baseplate only when the locking pin is in a single rotational orientation.

19. The extended magazine of claim 18, wherein the key and window are each trapezoid-shaped.

20. The extended magazine of claim 17, wherein the side bracket includes a receptacle in communication with the through-bore and the locking pin has a stop positioned within the receptacle.

21. The extended magazine of claim 20, wherein the receptacle has an upper face and the floor of the baseplate has an upper surface, the upper face and the upper surface limiting movement of the stop within the receptacle.

22. The extended magazine of claim 17, wherein the side bracket includes an upper surface and a portion of the shaft of the locking pin protrudes above the upper surface when the locking pin is moved to the unlocked position.

23. The extended magazine of claim 22, wherein the portion of the shaft does not protrude above the upper surface of the side bracket when the locking pin is moved to the locked position.

24. The extended magazine of claim 22, wherein the handgrip of the firearm prevents the portion of the locking pin from protruding fully above the upper surface of the side bracket when the magazine is inserted into the handgrip of the firearm, thereby preventing the locking pin from being moved to the unlocked position.

25. A firearm assembly, comprising:

a firearm having a handgrip;

a magazine in the handgrip and having a lower open end;

a baseplate structured to receive the lower open end of the magazine;

a side bracket structured to couple to the baseplate for securing the magazine; and a locking pin selectively moveable into a locked position to lock the side bracket to the baseplate and an unlocked position to unlock the side bracket from the baseplate, wherein the locking pin is prevented from being moved to the unlocked position by the handgrip of the firearm.

26. A magazine extender for coupling to an open end of a magazine, comprising:

a baseplate including an open proximal end, a closed distal end, a floor having a window and extending between the proximal and distal ends, and two side walls at opposite lateral sides of the floor, each of the side walls including a guide channel and a securing slot for receiving a rail of the magazine;

a side bracket including an upper surface, a lower surface, a receptacle extending upwardly from the lower surface, and a through-bore extending upwardly from the receptacle and terminating at the upper surface of the main body, and two legs extending distally, each leg sized to closely engage a respective one of the guide channels of the baseplate when the side bracket is secured to the baseplate; and a locking pin including a stop positioned within the receptacle of the side bracket, a shaft extending upwardly from the stop and into the through-bore of the side bracket, and a key extending downwardly from the stop, wherein the locking pin is selectively movable into a locked position and an unlocked position, the key of the locking pin engaging with the window of the baseplate in the locked position to lock the side bracket to the baseplate, the key of the locking pin disengaged from the window of the baseplate in the unlocked position to unlock the side bracket from the baseplate, and wherein a portion of the shaft of the locking pin protrudes above the upper surface of the side bracket when the locking pin is moved into the unlocked position.

* * * * *